US008120564B2

(12) United States Patent
Ku et al.

(10) Patent No.: US 8,120,564 B2
(45) Date of Patent: Feb. 21, 2012

(54) LOW POWER DRIVING METHOD AND DRIVING SIGNAL GENERATION METHOD FOR IMAGE DISPLAY APPARATUS

(75) Inventors: Ching-Hui Ku, Taipei County (TW); Hsiang-Lun Liu, Taoyuan County (TW); Shin-Chung Huang, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 682 days.

(21) Appl. No.: 12/249,971

(22) Filed: Oct. 13, 2008

(65) Prior Publication Data

US 2009/0102775 A1 Apr. 23, 2009

(30) Foreign Application Priority Data

Oct. 18, 2007 (TW) ..... 96139007 A

(51) Int. Cl.
*G09G 3/36* (2006.01)

(52) U.S. Cl. ..... 345/95; 345/99

(58) Field of Classification Search ..... 345/95, 345/99, 208–210

See application file for complete search history.

(56) References Cited

U.S. PATENT DOCUMENTS

| | | | | |
|---|---|---|---|---|
| 6,507,226 | B2 | 1/2003 | Swonger et al. | |
| 7,924,255 | B2 * | 4/2011 | Hsu et al. | 345/94 |
| 2002/0084968 | A1 * | 7/2002 | Park et al. | 345/92 |
| 2005/0174310 | A1 * | 8/2005 | Huang et al. | 345/87 |
| 2006/0071896 | A1 * | 4/2006 | Nakata et al. | 345/94 |

FOREIGN PATENT DOCUMENTS

| | | |
|---|---|---|
| CN | 1420387 | 5/2003 |
| CN | 1437061 | 8/2003 |
| TW | 200627361 | 8/2006 |

* cited by examiner

*Primary Examiner* — Chanh Nguyen
*Assistant Examiner* — Roy Rabindranath
(74) *Attorney, Agent, or Firm* — Jianq Chyun IP Office

(57) ABSTRACT

By a low power consumption driving method for an image display apparatus, unusual display may be prevented even if gate driving is not enough. When a rising edge of an output enable pulse is detected, a logic LOW gate driving signal is discharged to GND. When a falling edge of the output enable pulse is detected, the gate driving signal at GND is charged to logic HIGH. When a rising edge of the next output enable pulse is detected, the gate driving signal at logic HIGH is discharged to GND. When a falling edge of the next output enable pulse is detected, the gate driving signal at GND is charged to logic LOW. The image display apparatus is driven by the generated gate driving signals.

13 Claims, 6 Drawing Sheets

LOW POWER DRIVING METHOD AND DRIVING SIGNAL GENERATION METHOD FOR IMAGE DISPLAY APPARATUS

CROSS-REFERENCE TO RELATED APPLICATION

This application claims the priority benefit of Taiwan application serial no. 96139007, filed on Oct. 18, 2007. The entirety of the above-mentioned patent application is hereby incorporated by reference herein and made a part of this specification.

BACKGROUND OF THE INVENTION

1. Field of Invention

The present invention relates to a driving method for a display apparatus. More particularly, the present invention relates to a low power driving method for an image display apparatus, which is capable of avoiding unusual display even if the gate driving capability is not sufficient.

2. Description of Related Art

As the growing display market currently, flat-panel display apparatus has gradually become the mainstream. There are various types of flat-panel display apparatus, for example, liquid crystal display (LCD) apparatus, plasma display panel (PDP) apparatus etc. The LCD apparatus has advantages of small size, low driving voltages, low power consumption, low radiation, and so on.

FIG. 1 is a simplified block diagram of a conventional TFT-LCD apparatus. Referring to FIG. 1, the TFT-LCD apparatus 100 at least includes: a power supply 101, a DC-DC voltage conversion circuit 102, a timing controller 103, a gate driving circuit 104, a source driving circuit 105, a display panel 106, and a backlight source 107.

The DC-DC voltage conversion circuit 102 converts the voltage provided by the power supply 101, and supplies the converted DC voltage to other circuits, for example, the timing controller 103, the gate driving circuit 104, and the source driving circuit 105.

The timing controller 103 transmits an input image data IN to the source driving circuit 105 according to timing sequences, and further transmits source clock signals HCLK, source start pulses signals STH, polarity indication signals POL, and other signals to the source driving circuit 105. Moreover, the timing controller 103 transmits gate start pulse signals STV, gate clock signals CPV, and output enable signals OE, and so on to the gate driving circuit 104.

The source driving circuit 105 stores the received data into a register in the source driving circuit 105. Furthermore, the source driving circuit 105 converts the data into an analog voltage signal, and outputs the analog voltage signal to the display panel 106 for driving the display panel 106.

The display panel 106 is coupled to the source driving circuit 105 and the gate driving circuit 104. The display panel 106 is driven by a plurality of source driving signals S_OUT output by the source driving circuit 105, and by a plurality of gate driving signals G_OUT output by the gate driving circuit 104, so as to display images.

The display panel 106 includes a plurality of sub-pixels arranged in an array. Each sub-pixel includes a TFT, a liquid crystal capacitor, and a storage capacitor. The TFT serves as a switch, to control the gray-scale for each sub-pixel. The gate driving circuit 104 sequentially scans each scan line, so as to turn on the TFTs in sequence. When TFTs on the same scan line are turned on, the source driving circuit 105 inputs the frame data into the sub-pixels, so as to display images. The gate driving signal G_OUT determines whether the TFTs on the same scan line are turned on or not.

When the output enable signal OE is at logic HIGH, the gate driving signal G_OUT is at logic LOW forcibly, so as to prevent the display data on two adjacent horizontal display lines from interfering with each other such that unusual display would be avoided. In the conventional art, timing diagram of the gate clock signal CPV, the output enable signal OE, and the gate driving signal G_OUT are shown in FIG. 2.

When the gate driving signal G_OUT is at logic HIGH (VGH), the corresponding scan line in the display panel 106 is turned on. On the contrary, when the gate driving signal G_OUT is at logic LOW (VGL), the corresponding scan line in the display panel 106 is turned off.

Here, for example, VGH is +18V (i.e +18 volts) and VGL is −6V (i.e. −6 volts). Since the voltage required for turning on/off the TFT is as high as 24V (i.e. +18V−(−6V)=24V), power consumption is large.

Furthermore, when the driving capability of the gate driving circuit 104 is insufficient, ON/OFF switches of the TFT may be abnormal or unsatisfactory, and thus causing frame aberration. Generally, the insufficient driving of the gate driving circuit 104 may be caused by various reasons: for example, (1) the power supplied by the power supply 101 is not enough or the power supply is unstable; (2) if the impedance for the signal line of the panel is excessively high, the gate driving voltage applied to far-end sub-pixels (those far from the gate driving circuit) is not high enough, such that the ON/OFF of the far-end sub-pixels will be affected, and thus causing the unusual display.

Therefore, a driving method for a display apparatus that is capable of saving power and avoiding unusual display caused by insufficient driving capability of the gate driving circuit is required.

SUMMARY OF THE INVENTION

The present invention is directed to a driving method for a display apparatus and a method for generating a gate driving signal, which are capable of avoiding unusual display even if the gate driving capability is not sufficient.

The present invention is further directed to a driving method for a display apparatus and a method for generating a gate driving signal, which are capable of significantly reducing the power consumption by the gate driving.

A driving method for an image display apparatus is provided. The driving method includes: (a) generating an output enable signal, in which the output enable signal at least includes a first pulse and a second pulse; (b) discharging a gate driving signal at a first logic state to a reference potential when a signal transition of the first pulse is detected; (c) charging the gate driving signal at the reference potential to a second logic state when the other signal transition of the first pulse is detected; (d) discharging the gate driving signal at the second logic state to the reference potential when a signal transition of the second pulse is detected; (e) charging the gate driving signal at the reference potential to the first logic state when the other signal transition of the second pulse is detected; and (f) driving the image display apparatus according to the generated gate driving signal.

A driving signal generation method for an image display apparatus is still provided. The driving signal generation method includes: (a) detecting an output enable signal, in which the output enable signal at least includes a first pulse and a second pulse; (b) generating a gate driving signal at a logic LOW state when the first pulse of the output enable signal is at the logic LOW state; (c) coupling the gate driving signal at the logic LOW state to GND when the first pulse of the output enable signal transits from the logic LOW state to a first logic HIGH state; (d) maintaining the gate driving signal coupled to GND when the first pulse of the output enable signal remains at the first logic HIGH state; (e) charging the gate driving signal to a second logic HIGH state, and maintaining the gate driving signal at the second logic HIGH state when the first pulse of the output enable signal transits from the first logic HIGH state to the logic LOW state; (f) coupling the gate driving signal at the second logic HIGH state to GND when the second pulse of the output enable signal transits from the logic LOW state to the first logic HIGH state; (g) maintaining the gate driving signal coupled to GND when the second pulse of the output enable signal remains at the first logic HIGH state; and (h) charging the gate driving signal to the logic LOW state and maintaining the gate driving signal at the logic LOW state when the second pulse of the output enable signal transits from the first logic HIGH state to logic LOW state.

In order to make the aforementioned and other objectives, features, and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and constitute a part of this specification. The drawings illustrate embodiments of the invention and, together with the description, serve to explain the principles of the invention.

DESCRIPTION OF THE EMBODIMENTS

Figure 1:
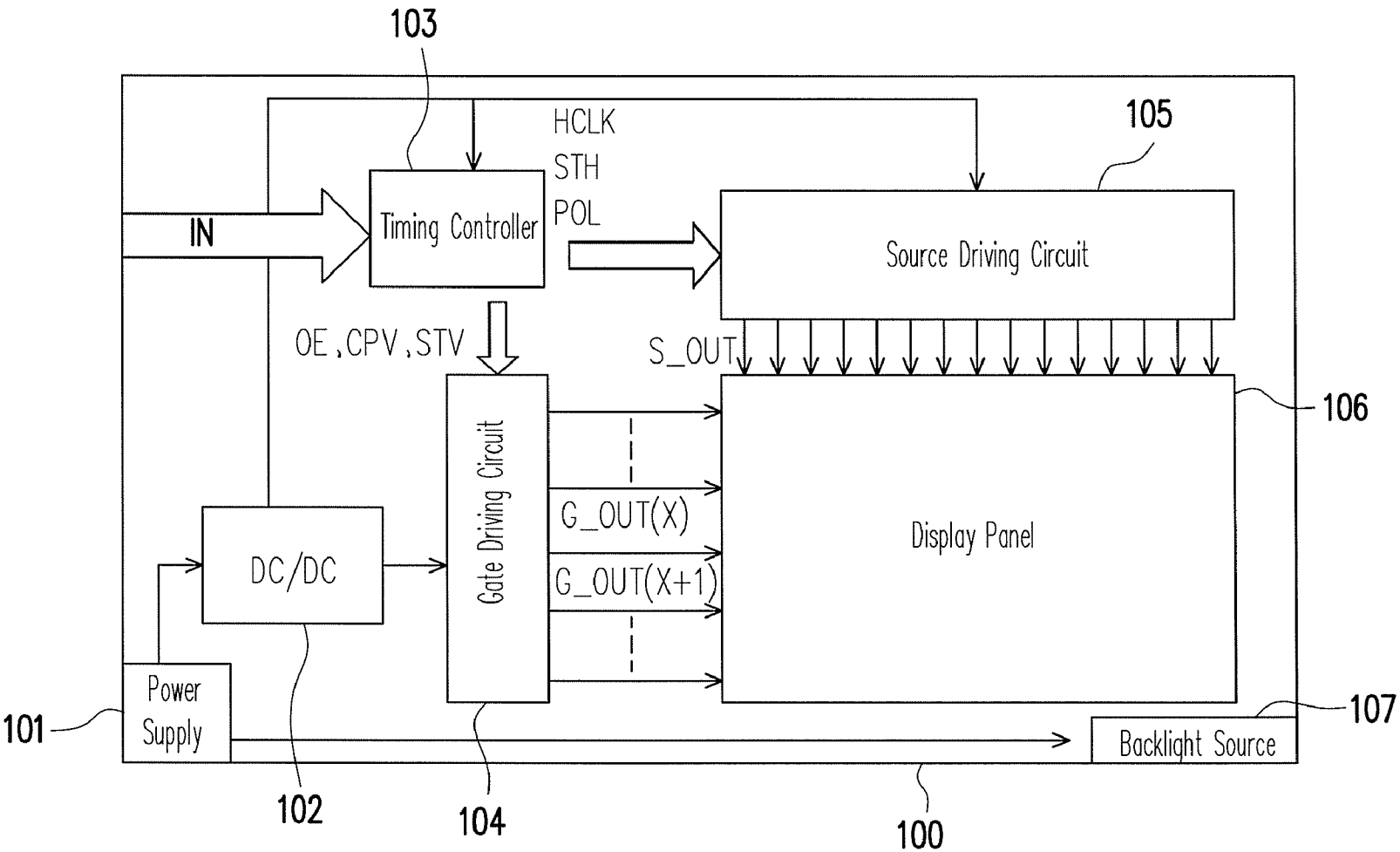
FIG. 1 (PRIOR ART)
FIG. 1 is a schematic block diagram of a conventional TFT-LCD apparatus.
Figure 2:
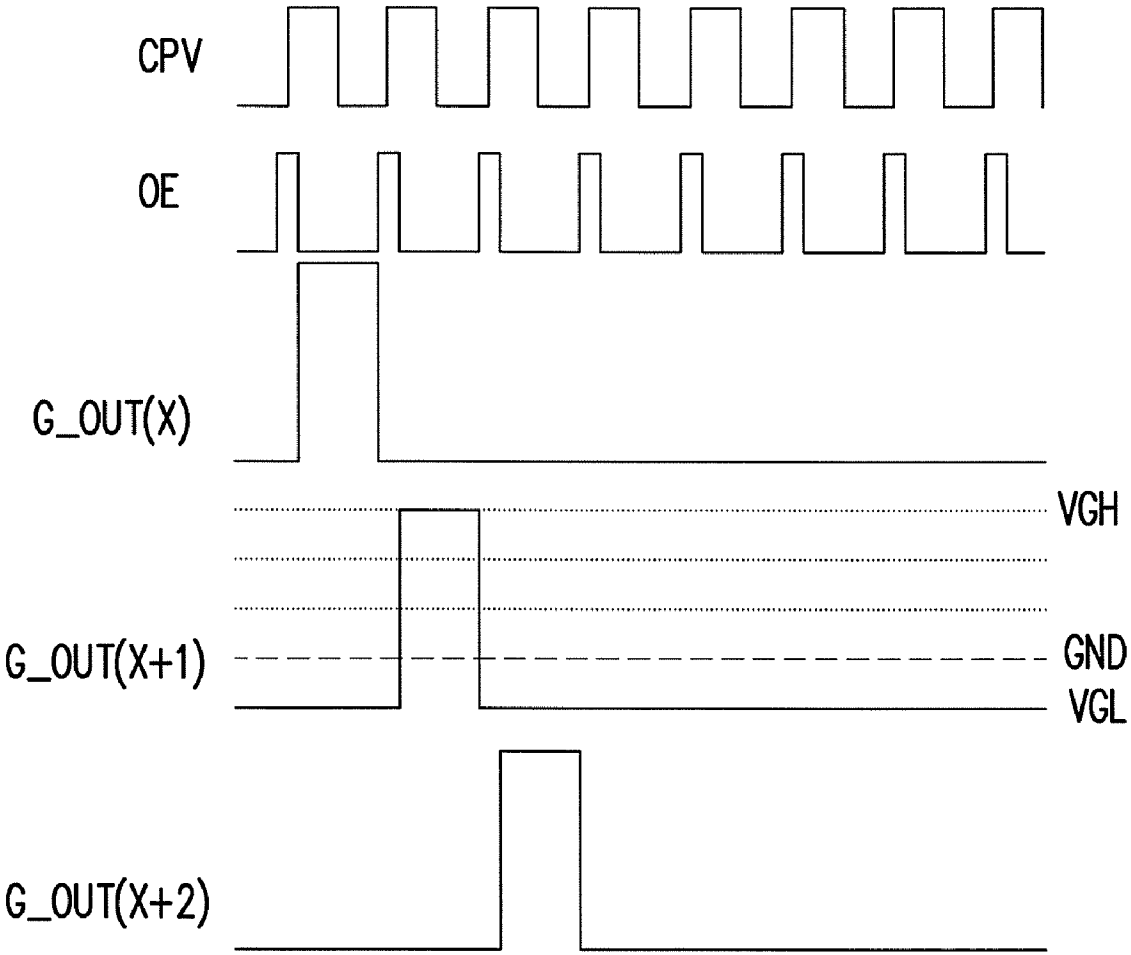
FIG. 2 (PRIOR ART)
FIG. 2 are timing diagram of a gate clock signal CPV, an output enable signal OE, and a gate driving signal G_OUT according to the conventional art.

Reference will now be made in detail to the present embodiments of the invention, examples of which are illustrated in the accompanying drawings. Wherever possible, the same reference numbers are used in the drawings and the description to refer to the same or like parts.

In embodiments of the present invention, the operating mechanism within the gate driving circuit is modified without increasing the circuit cost, so as to reduce the power consumption of the gate driving circuit, and to avoid the unusual display caused by the insufficient driving of the gate driving circuit.

When a rising edge of an output enable pulse is detected, a gate driving signal at logic LOW is discharged. When a falling edge of the output enable pulse is detected, the gate driving signal at GND is charged to logic HIGH. When a rising edge of the next output enable pulse is detected, the gate driving signal at the logic HIGH is discharged to GND. When a falling edge of the next output enable pulse is detected, the gate driving signal at GND is charged to logic LOW. In this way, the power consumption by the gate driving circuit may be reduced.

Figure 3:
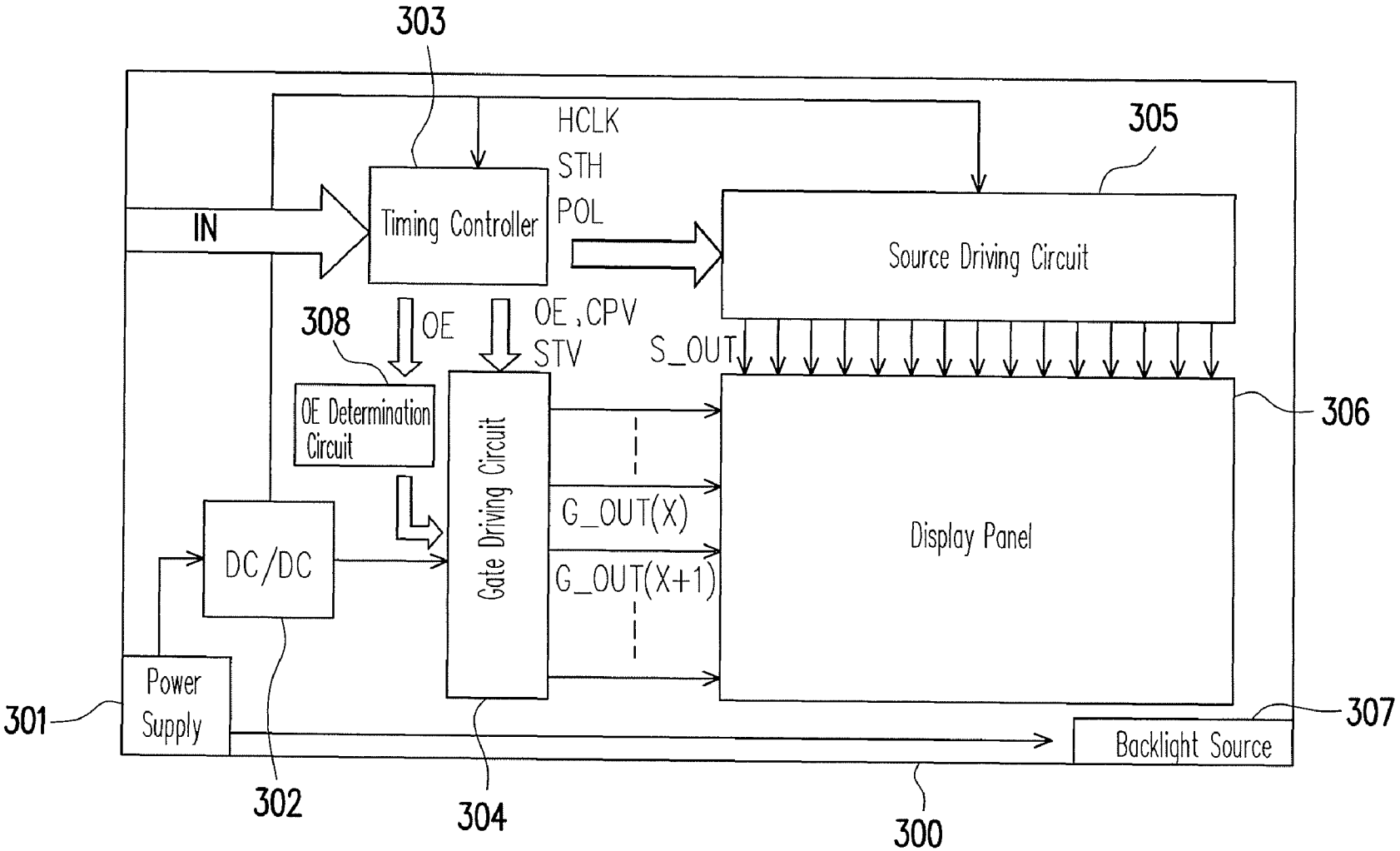
FIG. 3 is a schematic block diagram of a TFT-LCD apparatus according to an embodiment of the present invention.

FIG. 3 is a schematic block diagram of a TFT-LCD apparatus according to an embodiment of the present invention. Referring to FIG. 3, the TFT-LCD apparatus 300 at least includes: a power supply 301, a DC-DC voltage conversion circuit 302, a timing controller 303, a gate driving circuit 304, a source driving circuit 305, a display panel 306, a backlight source 307, and an OE (output enable) determination circuit 308.

The timing controller 303 sends a signal OE to the gate driving circuit 304 and the OE determination circuit 308. According to a rising edge of the received signal OE, the OE determination circuit 308 controls the gate driving circuit 304 to discharge a gate driving signal G_OUT. According to a falling edge of the received signal OE, the OE determination circuit 308 controls the gate driving circuit 304 to charge the gate driving signal G_OUT.

Figure 4:
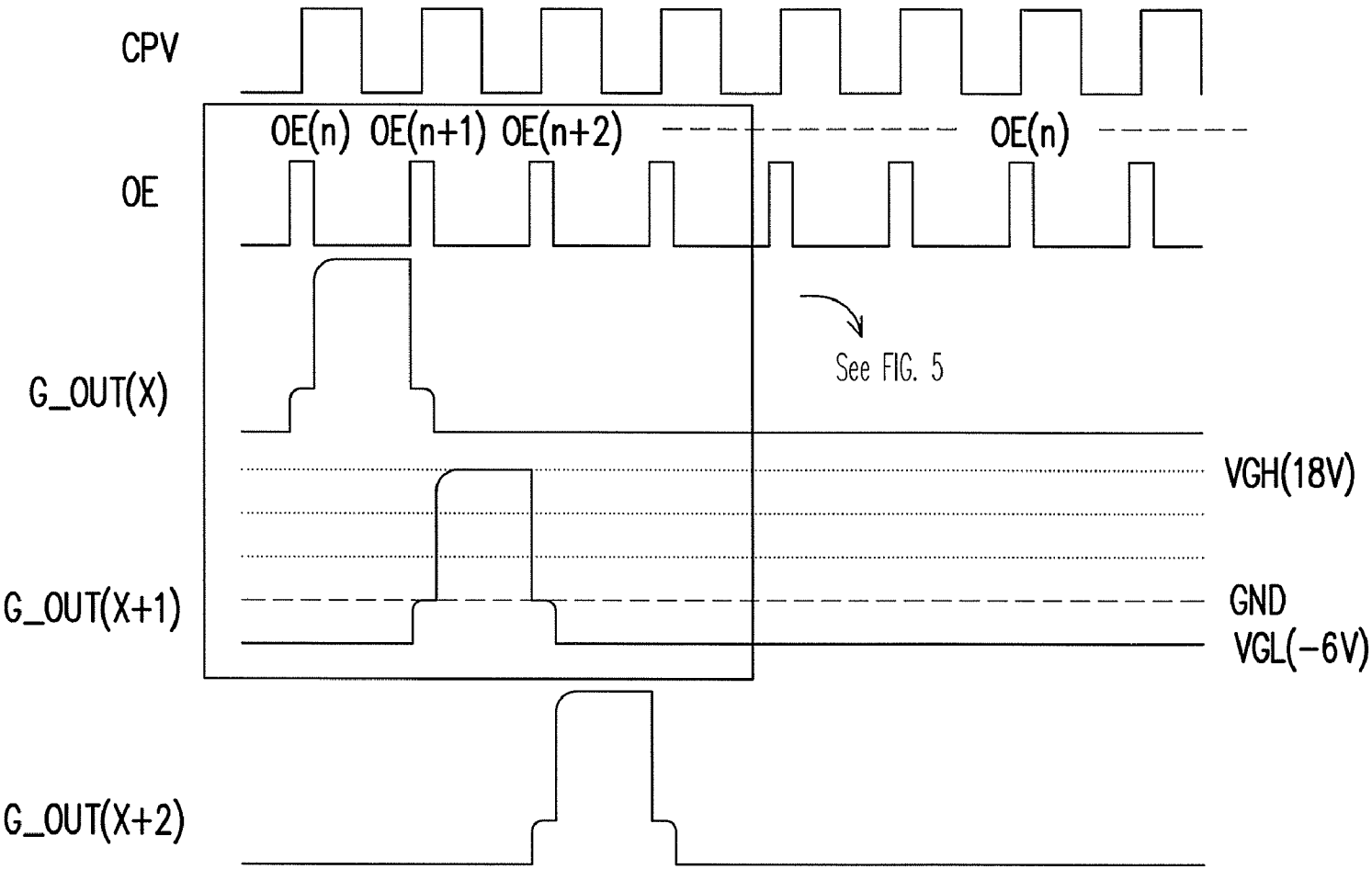
FIGS. 4 and 5 are timing diagrams of a gate clock signal CPV, an output enable signal OE, and a gate driving signal G_OUT according to this embodiment of the present invention.
Figure 5:
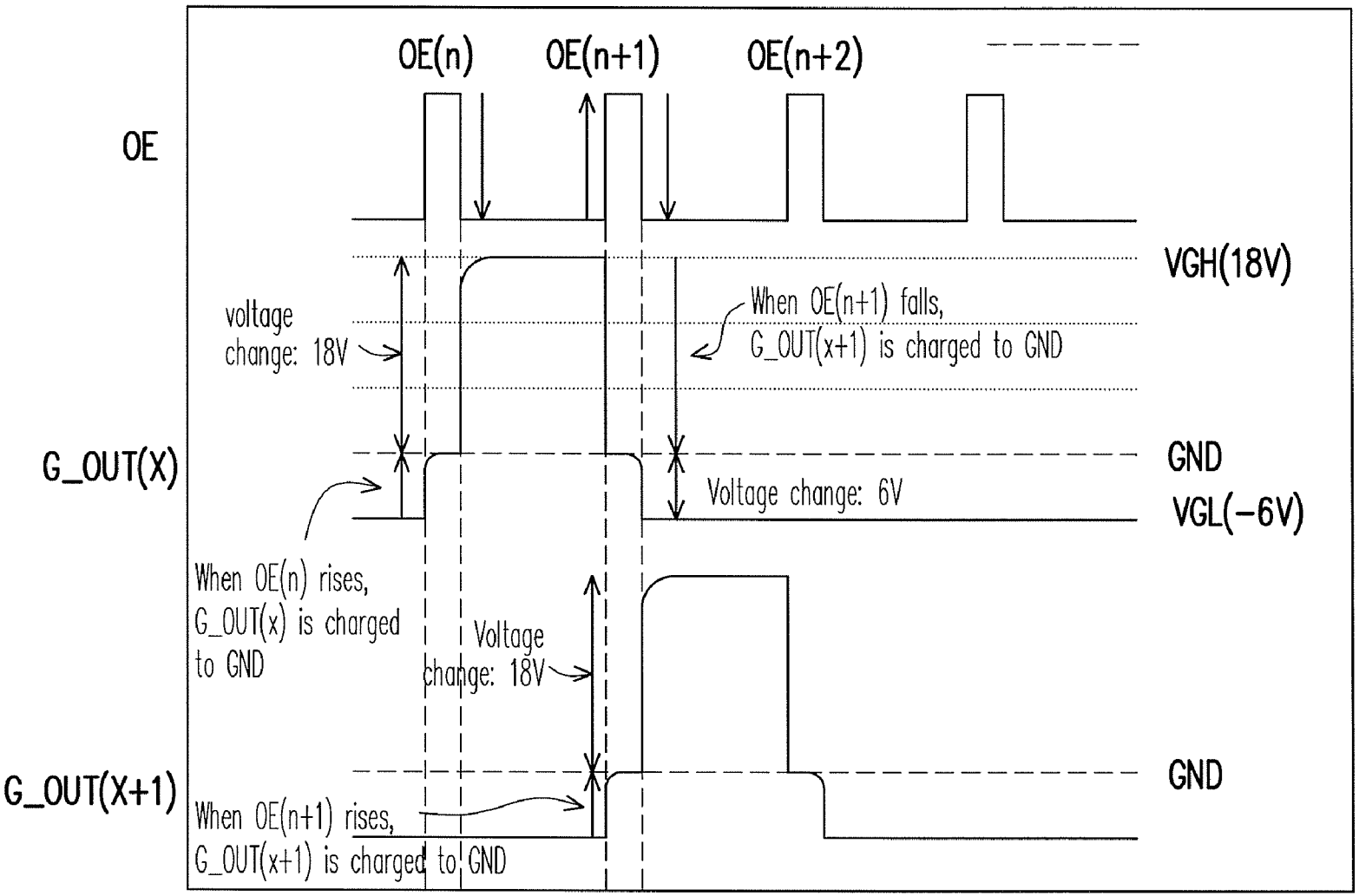

The impacts on the gate driving signal G_OUT caused by the OE determination circuit 308 can be known with reference to FIGS. 4 and 5. FIGS. 4 and 5 are timing diagrams of a gate clock signal CPV, an output enable signal OE, and a gate driving signal G_OUT according to this embodiment of the present invention. FIG. 5 is a partial enlarged view of FIG. 4. In FIGS. 4 and 5, for example, the logic HIGH potential VGH and the logic LOW potential VGL of the gate driving signal G_OUT are respectively +18V and −6V. However, those of ordinary skill in the art should understand that the present invention is not limited herein.

Referring to FIGS. 4 and 5, OE(n), OE(n+1) . . . respectively represent the nth pulse, the (n+1)th pulse in the output enable signal OE, and so forth. G_OUT(x), G_OUT (x+1) . . . respectively represent signals output by the gate driving circuit 304 to the xth line, the (x+1)th scan line of the display panel, and so forth.

In this embodiment, the waveform change of each gate driving signal G_OUT(x) . . . is divided into four phases, in which two of them are discharging phases, and the others are charging phases. The waveform change of the gate driving signal G_OUT(x) is taken as an example below, and the waveform change of any other gate driving signal G_OUT (x+1) . . . can be known similarly.

When the OE determination circuit 308 detects a rising edge of the output enable signal OE(n), the OE determination circuit 308 outputs a detection result to the gate driving circuit 304, such that the gate driving signal G_OUT(x) is discharged or adjusted from the logic LOW potential (−6V) to a reference potential (for example, the ground potential 0V). Here, the so-called "discharge" means, the gate driving signal G_OUT (x) is coupled to the ground terminal.

When the OE determination circuit 308 detects a falling edge of the output enable signal OE(n), the OE determination circuit 308 outputs another detection result to the gate driving circuit 304, such that the gate driving circuit 304 charges the gate driving signal G_OUT(x) from the ground potential (GND) to the logic HIGH potential VGH.

In the conventional art, when the falling edge of the output enable signal OE(n) appears, the gate driving signal G_OUT (x) is charged (i.e. raised forcedly) from the logic LOW potential VGL directly to the logic HIGH potential VGH. That is, in the conventional art, the conventional gate driving circuit needs to provide 24V (VGH−VGL=+18V−(−6V)

=24V), so as to change the gate driving signal G_OUT(x) from the logic LOW potential VGL to the logic HIGH potential VGH.

However, in this embodiment, (1) when the rising edge of the output enable signal OE(n) appears, the gate driving signal G_OUT(x) is discharged (i.e. not raised forcedly) from the logic LOW potential VGL to the ground potential (GND); next, (2) when the falling edge of the output enable signal OE(n) appears, the gate driving signal G_OUT(x) is charged (i.e. raised forcedly) from the ground potential (GND) to the logic HIGH potential VGH. That is, in this embodiment, the gate driving circuit 304 provides 18V (VGH−GND=+18V−0V=18V), so as to change the gate driving signal G_OUT(x) from the logic LOW potential VGL to the logic HIGH potential VGH.

Referring to FIGS. 4 and 5, when the OE determination circuit 308 detects a rising edge of the output enable signal OE(n+1), the OE determination circuit 308 outputs a detection result to the gate driving circuit 304, so as to discharge the gate driving signal G_OUT(x) from the logic HIGH potential (VGH, +18V) to the ground potential (0V).

When the OE determination circuit 308 detects a falling edge of the output enable signal OE(n+1) the OE determination circuit 308 outputs another detection result to the gate driving circuit 304, so as to charge the gate driving signal G_OUT(x) from the ground potential (GND) to the logic LOW potential VGL.

In the conventional art, when the rising edge of the output enable signal OE(n+1) appears, the gate driving signal G_OUT(x) is charged (i.e. raised forcedly) from the logic HIGH potential VGH to the logic LOW potential VGL. That is, in the conventional art, the conventional gate driving circuit provides 24V (VGL−VGH=−6V−18V=−24V), so as to change the gate driving signal G_OUT(x) from the logic HIGH potential VGH to the logic LOW potential VGL.

However, in this embodiment, (1) when the rising edge of the output enable signal OE(n+1) appears, the gate driving signal G_OUT(x) is discharged (i.e. not raised forcedly) from the logic HIGH potential VGH to the ground potential (GND); next, (2) when the falling edge of the output enable signal OE(n+1) appears, the gate driving signal G_OUT(x) is charged from the ground potential (GND) to the logic LOW potential VGL. That is, in this embodiment, the gate driving circuit 304 only needs to provide 6V (GND−VGL=0V−(−6V)=6V), so as to change the gate driving signal G_OUT(x) from the logic HIGH potential VGH to the logic LOW potential VGL.

Furthermore, as seen from FIG. 5, at the rising edge of OE(n+1), the gate driving signal G_OUT(x) is discharged from the logic HIGH potential VGH to the ground potential (GND), and the gate driving signal G_OUT(x+1) is discharged from the logic LOW potential VGL to the ground potential (GND).

As known from the above descriptions, in the conventional art, the gate driving circuit needs 48V (i.e. 24V+24V) to turn on/off a scan line. However, in this embodiment, the gate driving circuit just needs 24V (i.e. 18V+6V) to turn on/off a scan line. Therefore, this embodiment is significantly improved in terms of power consumption.

Moreover, in the conventional art, each time a scan line is turned on/off, the gate driving circuit charges the scan line by applying a voltage of 24V. If the charge time is insufficient or the supply voltage of the power supply is unstable (or the supply voltage of the power supply is not high enough), the charging process is incomplete, and as a result, the unusual display may easily occur. However, in this embodiment, in order to turn on a scan line, the gate driving circuit must charge the scan line with 18V; and in order to turn off a scan line, the gate driving circuit must charge the scan line with 6V. Therefore, even if the charge time is slightly insufficient, or the supply voltage of the power supply is slightly unstable (or the supply voltage of the power supply is not high enough slightly), the charging process still can be performed completely, and thus, the unusual display can be avoided.

Figure 6:
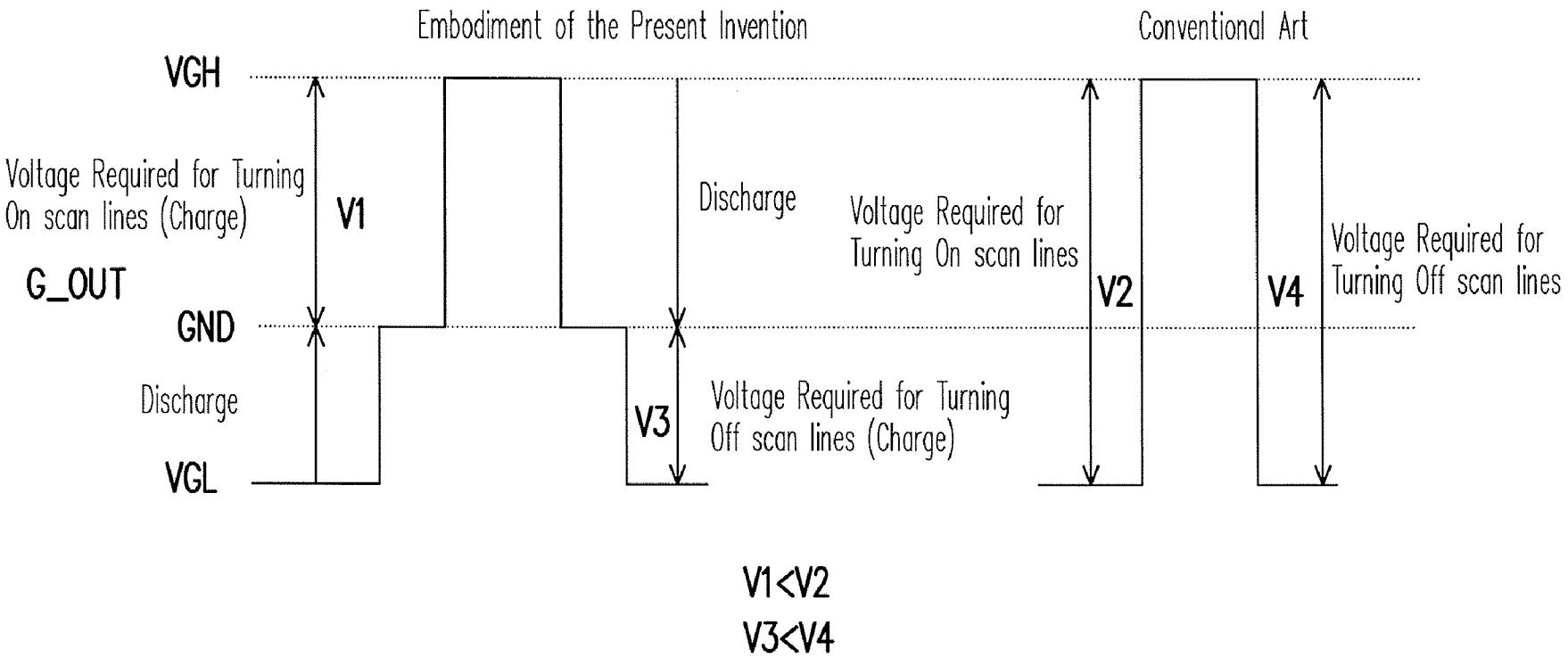
FIG. 6 is a comparison diagram of charging/discharging a gate driving signal in the embodiment of the present invention and in the conventional art, respectively.

FIG. 6 is a comparison diagram of charging/discharging a gate driving signal in the embodiment of the present invention and in the conventional art, respectively. As shown from FIG. 6, in order to turn on a scan line, a required voltage difference (V1) to be applied in the embodiment of the present invention is smaller than a required voltage difference (V2) to be applied in the conventional art; and in order to turn off a scan line, a required voltage difference (V3) to be applied in the embodiment of the present invention is smaller than a required voltage difference (V4) to be applied in the conventional art.

Embodiments of the present invention are not limited to be applied in LCD apparatus, and they may be applied to other types of image display apparatus, such as liquid crystal TV sets. Taking the liquid crystal TV sets for example, the logic HIGH potential (VGH) may be higher than +20V, and the logic LOW potential (VGL) may be lower than −10V. Therefore, when the embodiment of the present invention is applied to the liquid crystal TV set, the power consumption can be greatly reduced, and the unusual display caused by the insufficient gate driving can be avoided.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A driving method for an image display apparatus, comprising:

(a) generating an output enable signal, wherein the output enable signal at least comprises a first pulse and a second pulse;

(b) discharging a gate driving signal at a logic LOW potential to a reference potential when a first signal transition of the first pulse is detected, wherein the reference potential is greater than the logic LOW potential;

(c) charging the gate driving signal at the reference potential to a logic HIGH potential when a second signal transition of the first pulse is detected, wherein the logic HIGH potential is greater than the reference potential;

(d) discharging the gate driving signal at the logic HIGH potential to the reference potential when a first signal transition of the second pulse is detected;

(e) charging the gate driving signal at the reference potential to the logic LOW potential when a second signal transition of the second pulse is detected; and (f) driving the image display apparatus according to the generated gate driving signal.

2. The driving method as claimed in claim 1, wherein the reference potential is a ground potential.

3. The driving method as claimed in claim 1, wherein the step (b) comprises:

detecting a rising edge of the first pulse.

4. The driving method as claimed in claim 1, wherein the step (c) comprises:

detecting a falling edge of the first pulse.

5. The driving method as claimed in claim 1, wherein the step (d) comprises:

detecting a rising edge of the second pulse.

6. The driving method as claimed in claim 1, wherein the step (e) comprises:

detecting a falling edge of the second pulse.

7. The driving method as claimed in claim 1, wherein the image display apparatus comprises a liquid crystal display apparatus.

8. A driving signal generation method, applicable for an image display apparatus, comprising:

detecting an output enable signal, wherein the output enable signal at least comprises a first pulse and a second pulse;

generating a gate driving signal at a second logic state when the first pulse of the output enable signal is at a first logic state;

coupling the gate driving signal at the second logic state to a reference potential when the first pulse of the output enable signal transits from the first logic state to a third logic state;

maintaining the gate driving signal at the reference potential when the first pulse of the output enable signal remains at the third logic state;

charging the gate driving signal to a fourth logic state, and maintaining the gate driving signal at the fourth logic state when the first pulse of the output enable signal transits from the third logic state to the first logic state;

coupling the gate driving signal at the fourth logic state to the reference potential when the second pulse of the output enable signal transits from the first logic state to the third logic state;

maintaining the gate driving signal at the reference potential when the second pulse of the output enable signal remains at the third logic state; and charging the gate driving signal to the second logic state and maintaining the gate driving signal at the second logic state when the second pulse of the output enable signal transits from the third logic state to the first logic state.

9. The driving signal generation method as claimed in claim 8, wherein the first logic state is logic LOW.

10. The driving signal generation method as claimed in claim 8, wherein the second logic state is logic LOW.

11. The driving signal generation method as claimed in claim 8, wherein the third logic state is logic HIGH.

12. The driving signal generation method as claimed in claim 8, wherein the fourth logic state is logic HIGH.

13. The driving signal generation method as claimed in claim 8, wherein the image display apparatus comprises a liquid crystal display apparatus.

* * * * *